US008398205B2

(12) United States Patent
Roth et al.

(10) Patent No.: US 8,398,205 B2
(45) Date of Patent: Mar. 19, 2013

(54) WIPING DEVICE FOR INKJET PRINTERS

(75) Inventors: Teressa L. Roth, Brush Prairie, WA (US); Hai-Lung James Hung, Jhonge (TW); Jafar N. Jefferson, Vancouver, WA (US); Eric Collins, Portland, OR (US); Jennifer Peterson, Washougal, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 236 days.

(21) Appl. No.: 12/823,523

(22) Filed: Jun. 25, 2010

(65) Prior Publication Data

US 2011/0316928 A1 Dec. 29, 2011

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 4,371,881 | A * | 2/1983 | Bork et al. | 347/29 |
| 5,585,826 | A | 12/1996 | Schroeder et al. | |
| 5,847,728 | A * | 12/1998 | Lee | 347/33 |
| 5,920,330 | A * | 7/1999 | Ikezaki | 347/33 |
| 6,179,404 | B1 * | 1/2001 | Kawarama et al. | 347/31 |
| 6,398,340 | B1 * | 6/2002 | Lin | 347/33 |
| 6,601,943 | B2 | 8/2003 | Barinaga | |
| 6,644,776 | B1 | 11/2003 | Barinaga et al. | |
| 6,761,428 | B2 | 7/2004 | Agarwal et al. | |
| 7,347,528 | B2 | 3/2008 | Van Gerven | |
| 7,416,271 | B2 | 8/2008 | Umeda | |
| 7,997,683 | B2 * | 8/2011 | Mealy et al. | 347/33 |
| 2001/0024216 | A1 * | 9/2001 | Kim | 347/33 |
| 2002/0122092 | A1 * | 9/2002 | Okamura et al. | 347/33 |
| 2006/0164460 | A1 * | 7/2006 | Uwagaki et al. | 347/32 |
| 2007/0103504 | A1 * | 5/2007 | Huang | 347/29 |
| 2009/0085955 | A1 * | 4/2009 | Eguchi et al. | 347/19 |
| 2011/0310171 | A1 * | 12/2011 | Supron et al. | 347/33 |

FOREIGN PATENT DOCUMENTS

| | | | |
|---|---|---|---|
| JP | 3032848 A | | 2/1991 |
| JP | 03032848 A | * | 2/1991 |
| JP | 7323554 A | | 12/1995 |

* cited by examiner

*Primary Examiner* — Matthew Luu
*Assistant Examiner* — Justin Seo

(57) ABSTRACT

A wiping device for an inkjet printer includes a wiper mount moveable between a wiping position and a non-wiping position. A slider coupled to the wiper mount, translates between a retracted position and a deployed position. A first translation of the slider to the deployed position causes the wiper mount to move into the wiping position. A trigger, operable between a cocked position and an un-cocked position is coupled to the slider. In the cocked position, the trigger locks the wiper mount in the wiping position. When actuated, the trigger moves to the un-cocked position and the wiper mount moves to the non-wiping position. The wiping device includes logic to control the actuation and non-actuation of trigger.

20 Claims, 16 Drawing Sheets

WIPING DEVICE FOR INKJET PRINTERS

BACKGROUND

Inkjet printers typically use one or more print head assemblies, each of which includes an ink supply and means for directing fine droplets of ink through an interface on to a print medium. In a typical inkjet printer that uses two print head assemblies, one is for black-ink, and one is for color-ink printing. Each print head assembly includes an orifice plate in which are formed hundreds of very small orifices through which ink is ejected or sprayed onto the print medium. The small orifices are susceptible to clogging from accumulated ink and debris, and the inkjet printer may use some type of wiping mechanism or system to remove the accumulated ink and debris from the orifice area. The wiping system design then becomes an important element in the overall design of an inkjet printer.

The print head assemblies are carried in a carriage that may translate along the +X/−X axis to inject ink onto the print medium, with the print medium advancing along the +Y/−Y axis. When not in use (i.e., when the inkjet printer is not executing any print commands), the print head assemblies, and primarily the orifice plate areas, are placed "in cap."

Typical inkjet printer wiping systems fall into one of two categories. Orthogonal axis wiping systems use a carriage to hold the print head assemblies fixed with respect to the printer, and a separately-powered system moves the wiper mechanism past the fixed print head assemblies, in either a rotary or linear motion. One drawback to orthogonal wiping systems is the need for a separate power source to move the wiper mechanism. Scan axis wiping systems use a wiper mechanism that is mounted parallel to the nozzle rows, and a carriage holding the print head assemblies causes the assemblies to move past the wiper mechanism. One drawback to scan axis wiping systems is that they require additional room in the direction of wiping, which translates into a wider inkjet printer. In some prior art applications, the scan axis wiping functionality is merged in the same location as the capping station. However, this solution means the print head assemblies need to wipe every time they either come out of or go into cap.

DESCRIPTION OF THE DRAWINGS

The Detailed Description will refer to the following drawings, in which like numbers refer to like objects, and in which.

DETAILED DESCRIPTION

Figure 1:
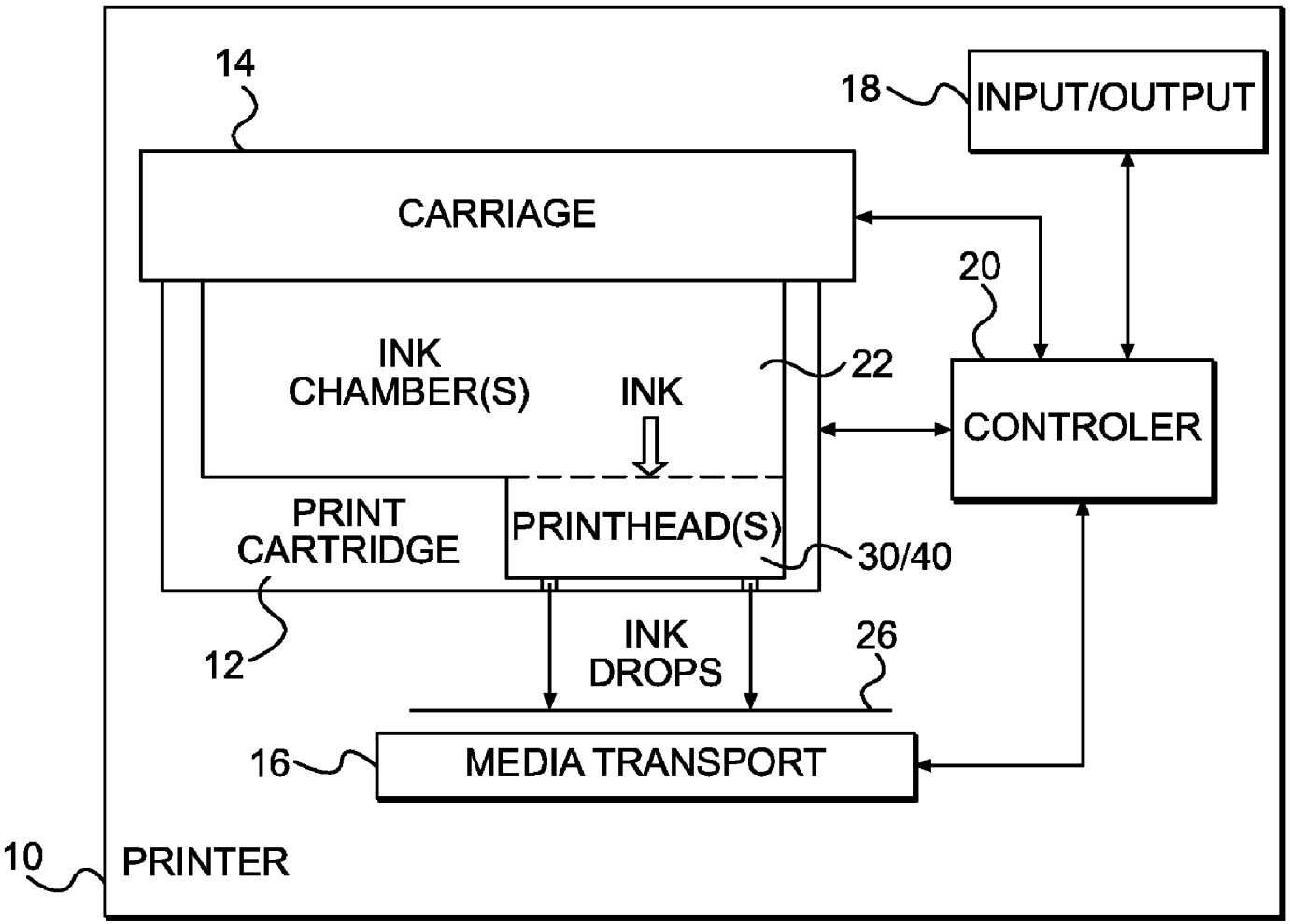
FIG. 1 illustrates, in block diagram form, an embodiment of an inkjet printer in which embodiments of the wiping device may be implemented.

Inkjet printers use one or more print cartridges (sometimes called pens) that include an ink supply and means for directing fine droplets of ink on to a print medium (e.g., paper). The means for directing the ink on to the print medium includes a print head assembly with an orifice plate, the orifice plate having formed, in an orifice area, hundreds of very small orifices. This arrangement of print head assemblies can cause problems to occur with respect to the desired application of the ink, including the accumulation of ink and debris in the orifice area. To solve or at least minimize these problems, the inkjet printer may include some type of wiping mechanism whereby the orifice area periodically is wiped to remove the accumulated ink and debris to maintain pen health.

Many inkjet printers have scan axis wiping systems that are engaged by a carriage which raises the wiper. After a wiping operation, these wiping systems are disengaged by the carriage passing a specific location beyond the point of wiping. One problem with these systems is that they force the wiper to wipe the print head assembly every time the print head assembly comes out of cap. This problem in turn may lead to a delay in printing the first page out because the wiping operation must first be completed before the printing operation begins.

An improvement in wiping device design over that in previous inkjet printers is disclosed. In an embodiment, a wiping device is activated by one inkjet printer system that already contains a motor and is deactivated by another inkjet printer system that also already includes a motor, without coupling the two systems together. In this embodiment, a carriage system, which includes a carriage and a carriage motor, deploys the wiping device and a paper path system and paper path motor retracts the wiping device. Operation of the paper path motor to retract the wiping device may be controlled by a suitably programmed processor installed as a component of the inkjet printer. In an alternate embodiment, the carriage system is programmed to both deploy and retract the wiping device. In either embodiment, processor programming may be accomplished in hardware or software, or a combination of hardware and software. In an embodiment, the programming determines when, or under what circumstances, the paper path motor is energized. In an embodiment, the programming is set during manufacture of the inkjet printer and generally cannot be altered by a user of the inkjet printer. In another embodiment, logic that controls the wiping operation, as well as operation of the carriage system and the paper path system, may be implemented as a hardware device, such as a mechanical counter, for example. This improved wiping device design maintains the print head assembly orifice plates clear of ink and debris (i.e., maintaining pen health) without affecting the quickness of printing the first page (i.e., "the first page out") of a print job by using selective wiping of the print head assembly orifice plates that does not force wiping of the orifice area each time a print head assembly comes out of cap. This improved design further results in a wiping device that does not require its own power source, thereby permitting construction of a simpler, less expensive inkjet printer. In an embodiment, the improved design may be implemented as a scan axis wiping device.

The improved wiping device includes a sliding device that cooperates with a pivotable wiper mount and wiper to move the wiper mount into a wiping position, a trigger or latch component to hold the pivotable wiper mount in the wiping position and to then allow the pivotable wiper mount to return to a non-wiping position, and a programmed processor to provide movement control of the wiper mount. Mechanically, an embodiment of the wiping device includes a wiper, a wiper mount, a wiper sled, and a trigger, which cooperate with the engaging carriage system and the dis-engaging paper path system. The wiper sled and trigger may be located in a frame. The wiper sled and trigger may be molded from an ABS plastic reinforced with about 20 percent glass fibers. In an alternate embodiment, mechanical components of a wiping device include a lever arm operated by the carriage system. The lever arm engages and disengages a latch through a cog arrangement to move a wiper mount and wiper from a non-wiping position to a wiping position, and to allow the wiper mount to return to the non-wiping position. The wiper may be an elastomer part that is held and located by the wiper sled. The wiper may be sized to be approximately the same width as the width of the orifice plate. The wiper may be set at a desired interference level such that the interference is greater than zero (i.e., no gap between the wiper and the orifice plate) and less than a value that would prevent motion of the carriage. The print head assembly moves past the wiper in either one direction or bi-directionally, and debris and ink accumulated on the orifice area are removed.

In an embodiment the wiper is a single, compliant wiper fixed to a pivotable wiper mount that rotates between a wiping position and a non-wiping position. The wiper sled, which is used to locate the pivotable wiper mount, translates in the scan axis of the inkjet printer between a dis-engaged position and engaged position. A first translation of the wiper sled causes rotation of the pivotable wiper mount into the wiping position to correspond to the engaged position of the wiper sled. The wiper sled can be locked in the engaged position by one or both of two mechanisms, namely movement of a cap sled, as will be described below, or cocking of the trigger. The trigger operates between a cocked position and an un-cocked position. In the cocked position, the trigger locks the pivotable wiper mount in the wiping position. When actuated, the trigger moves to the un-cocked position and the wiper mount moves to the non-wiping position.

FIG. 1 shows, in block diagram form, an embodiment of an inkjet printer in which embodiments of the disclosed wiping device may be implemented. In FIG. 1, inkjet printer 10 includes a print cartridge 12, a carriage 14, a print media transport mechanism 16, an input/output device 18, and a printer controller 20 connected to each of the operative components of printer 10. Print cartridge 12 includes one or more ink holding chambers 22 and one or more print head assemblies 30/40. A print cartridge is sometimes also referred to as an ink pen or an ink cartridge. A print head assembly represents generally a small electromechanical part that contains an array of miniature thermal resistors or piezoelectric devices that are energized to eject small droplets of ink out of an associated array of orifices. A typical thermal inkjet print head assembly, for example, includes an orifice plate arrayed with ink ejection orifices and firing resistors formed on an integrated circuit chip. Each print head assembly is electrically connected to the printer controller 20 through external electrical contacts. In operation, the printer controller 20 selectively energizes the firing resistors through the electrical contacts to eject a drop of ink through an orifice on to the print media 26.

Print cartridge 12 may include a series of stationary cartridges or print head assemblies that span the width of the print media 26. Alternatively, the cartridge 12 may include one or more cartridges that scan back and forth on the carriage 14 across the width of the print media 26. Other cartridge or print head assembly configurations are possible. Movable carriage 14 may include a holder for the print cartridge 12, a guide along which the holder moves, a drive motor, and a belt and pulley system that moves the holder along the guide. Media transport 16 advances the print media 26 lengthwise past the print cartridge 12 and the print head assembly. Controller 20 may communicate with external devices through the input/output device 18, including receiving print jobs from a computer or other host device. Controller 20 controls the movement of the carriage 14 and the media transport 16. By coordinating the relative position of the print cartridge 12 and the print head assembly with the print media 26 and the ejection of ink drops, the controller 20 produces the desired image on the print media 26. As will be discussed later in more detail, in an embodiment, the controller 20 also may control wiping operations of the inkjet printer 10 by controlling, for example, a power on signal to the paper path motor so as to disengage the wiping device. In another embodiment, logic to control the wiping operations of the inkjet printer 10 may be implemented as a mechanical device, or as a combination of a mechanical device and a suitably programmed processor.

Figure 2:
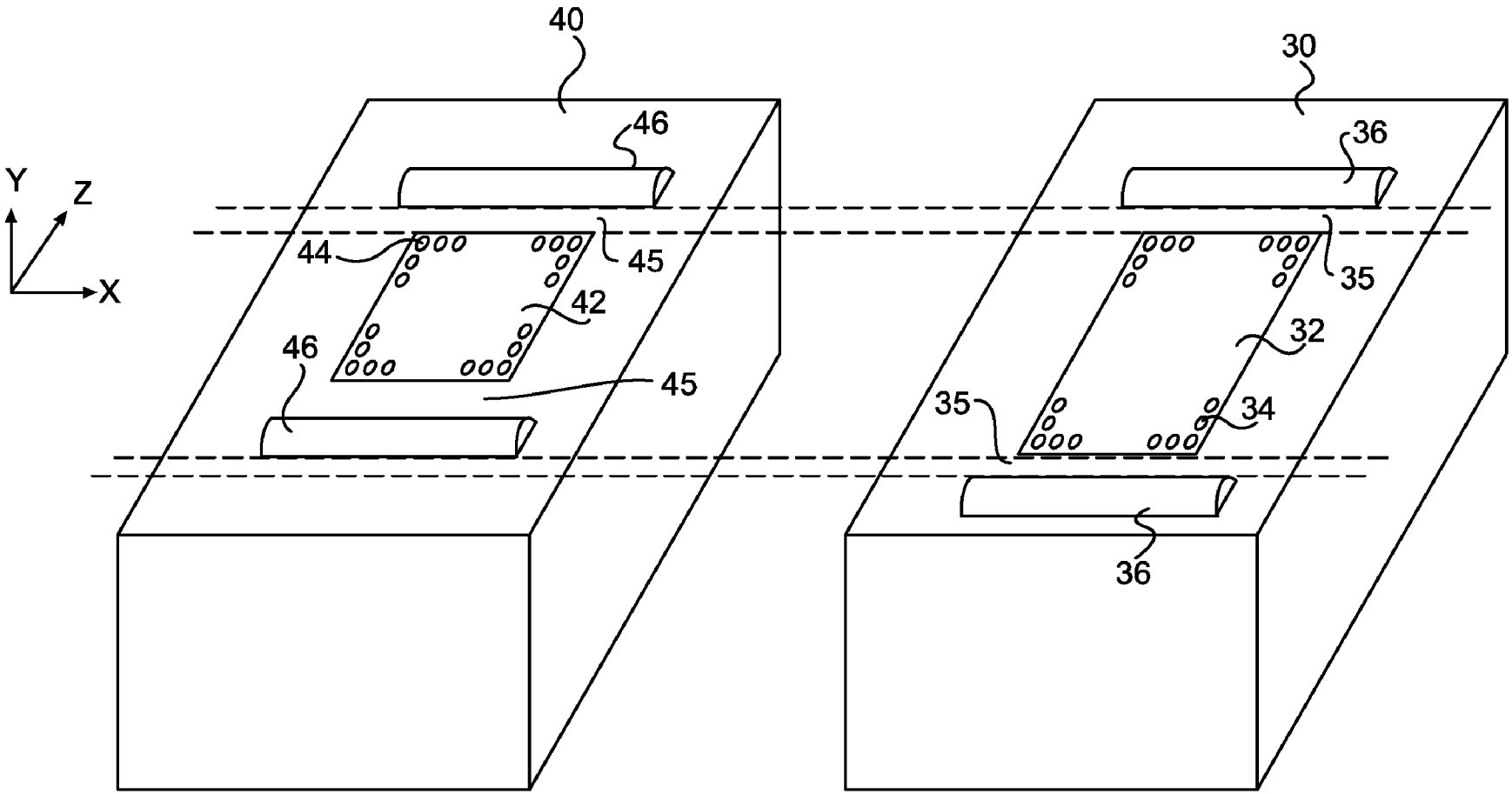
FIG. 2 illustrates an embodiment of print head assemblies that may be used with the inkjet printer of FIG. 1.

FIG. 2 illustrates the generally planar surfaces of the color- and black-ink print head assemblies in the area of the orifice plates. Color-ink print head assembly 40 includes orifice area 42 having a number of orifices 44 arranged in columns along the Y-axis. At either end of the orifice columns are small sections 45 of the orifice area 42 in which no orifices 44 are formed, followed by encapsulants 46 that contain electrical connections between an ink ejection mechanism and printer electrical control circuits. Black-ink print head assembly 30 includes orifice area 32 having a number of orifices 34 arranged in columns. At the end of each column are orifice-free sections 35 followed by encapsulants 36. The encapsulants 46 and 36 are raised slightly above the generally planar orifice areas 42 and 32.

Figure 3:
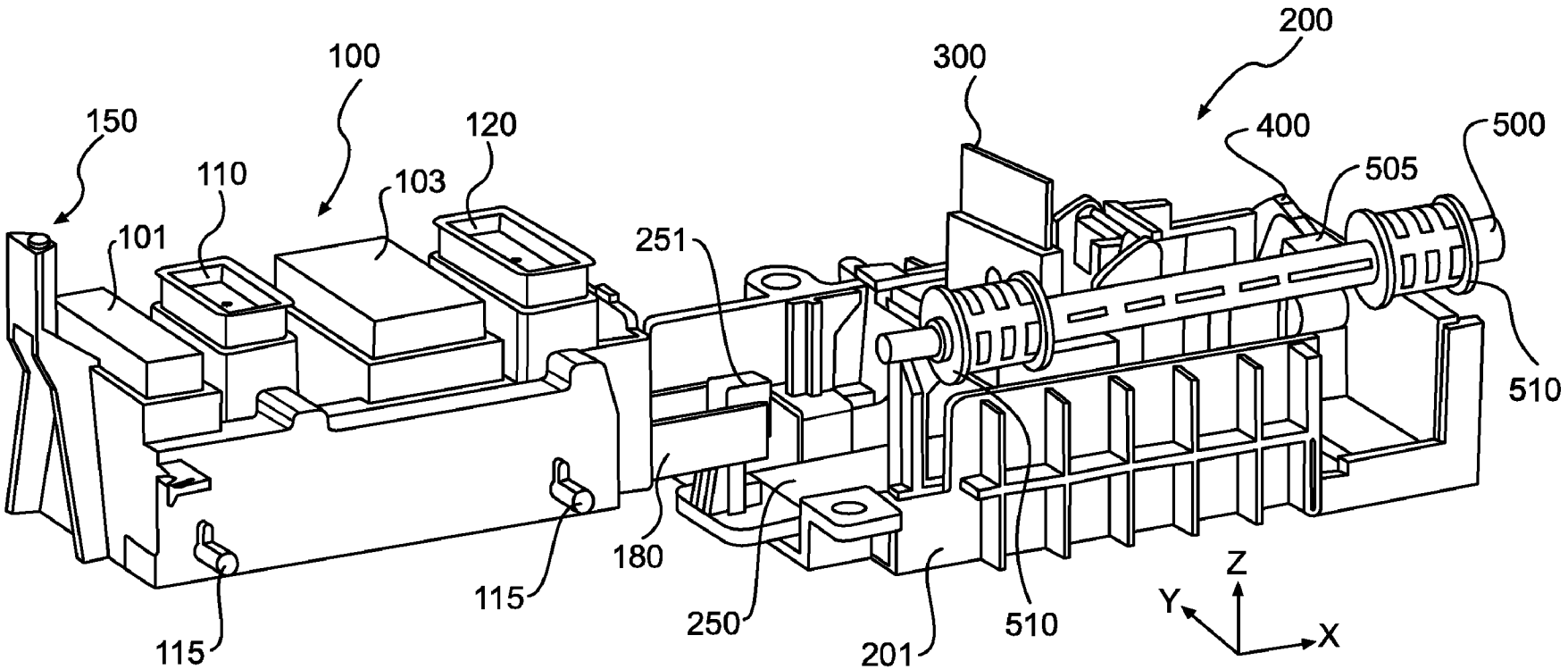
FIG. 3 is a perspective view of an embodiment of components of the inkjet printer of FIG. 1.

FIG. 3 is a perspective view of an example embodiment of selected components of the inkjet printer of FIG. 1. Cap sled 100 includes compliant caps 110 and 120. The caps 110 and 120 are used, respectively, to cap the color- and black-ink print head assemblies 40 and 30 when, for example, there are no printing operations in progress, so as to limit dry-out of ink at the orifice plate areas 32, 42. When printing operations are called for, the print head assemblies 30, 40 are taken out of cap. In an embodiment, cap sled 100 is molded from an ABS plastic reinforced with about 20 percent glass fibers. The cap sled 100 primarily moves along the +X/−X axis, and to a more limited degree, along the +Z/−Z axis, using, in an embodiment, a ramp (not shown). To provide the desired +X/−X movement of the cap sled 100, carriage 14 (see FIG. 1) that houses the print head assemblies contacts the cap sled 100 by way of cap sled pin 150. As the carriage 14 pushes against the pin 150, the cap sled 100, in an embodiment, is driven up a short, shallow ramp to create +Z-direction travel of the caps 110/120. Once driven completely up the ramp, the cap sled 100 is in its capping position and the caps 110 and 120 press against their respective print head assemblies, create an adequate seal, and thus create a desired humid environment around the print head assembly orifice plate areas.

In an alternative embodiment, instead of a ramp, a planar linkage mechanism may be used. A specific example of a planar linkage mechanism is a four-bar linkage mechanism. Such a four-bar linkage mechanism can translate X-direction motion of the cap sled into Z-direction motion without rotation of the cap sled. When a four-bar linkage mechanism is used, the mechanism is coupled to the cap sled 100 by support pins 115 (two of four shown in FIG. 3). Other mechanisms may be used to translate X-direction motion into Z-direction motion of the cap sled 100.

Adjacent to the caps 110 and 120 are, respectively, blotters 101 and 103.

Frame 201 is fixed within the inkjet printer 10 (FIG. 1). Frame 201 is used to locate mechanical components of the wiping device 200, including wiper sled 250 and trigger 400. Cap sled 100 is coupled to wiper sled 250 by interaction between coupler 180 on the cap sled 100 and wiper sled post 251. The trigger 400 may be engaged by paddle 505 of output shaft 500, which in turn is operated by a paper path motor (not shown). Also shown affixed to the output shaft 500 are wheels 510. The wheels 510 are used to mount rubber tires (not shown). The rubber tires are used to grip the printing medium.

In FIG. 3, cap sled 100 is shown at its maximum −X-direction and +Z-direction travel (i.e., at the capping position). In the capping position of the cap sled 100, the wiper sled 250 is moved to its maximum −X-direction position; the wiper 300 is raised and held in a wiping position by the −X-axis position of the cap sled 100 and the wiper sled 250. When the print head assemblies 30/40 come out of cap, the cap sled 100 is released, and a spring (not shown in FIG. 3) causes the cap sled 100 to move in the +X-direction. However, as will be discussed later, the trigger 400 is now engaged, or cocked, and serves to hold the wiper 300 in the wiping position. Subsequent (clockwise) rotation of the output shaft 500 such that the paddle 505 pushes against the trigger 400 actuates (uncocks) the trigger 400, which allows the wiper sled 250, under a spring force, to move in the +X direction, which in turn lowers the wiper 300 out of the paper print path to allow printing operations and prevent wiping operations.

Figure 4:
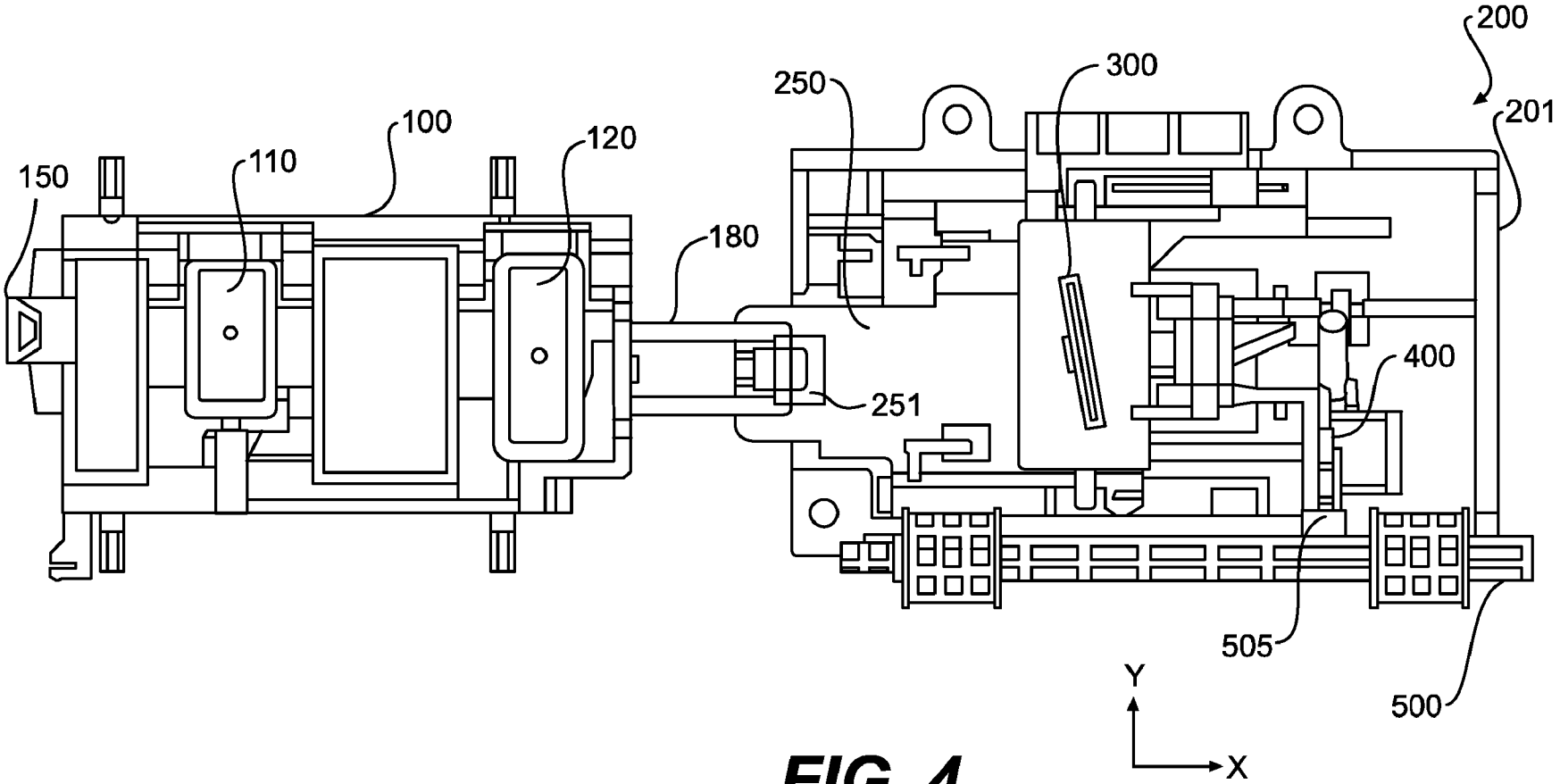
FIG. 4 is a top-level view of the embodiment of FIG. 3.

FIG. 4 is a top level view of the components of FIG. 3. As can be seen in FIG. 4, output shaft 500 is designed to interact with the wiper device 200 by means of paddle 505 formed on the output shaft 500. The output shaft 500 rotates about the X-axis under direction of controller 20 (see FIG. 1), and is powered by a paper path motor (not shown).

Figure 5:
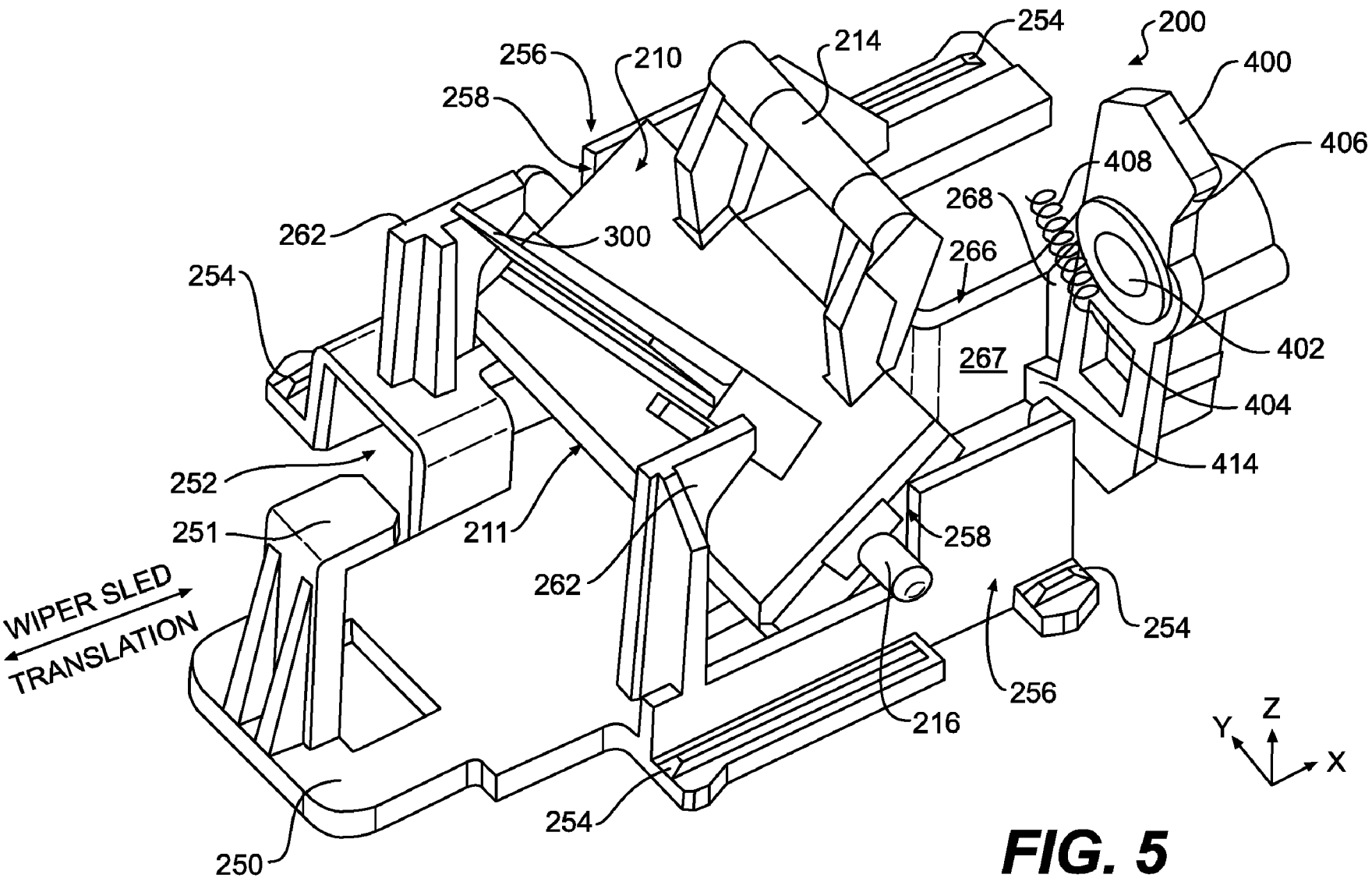
FIG. 5 illustrates mechanical components of an embodiment of a wiping device for use with the inkjet printer of FIG. 1.

FIG. 5 illustrates mechanical components of an embodiment of a wiping device 200 for use with the inkjet printer of FIG. 1. As can be seen in FIG. 5, mechanical components of the wiping device 200 include wiper mount 210 wiper sled 250, wiper 300, and trigger 400, all of which are located in frame 201 (see FIG. 4). The wiper sled 250 is movable (i.e., translates) in the +X and −X directions, and is pulled in the −X direction by the cap sled 100, which attaches at wiper sled post 251 and spring returns in the +X direction by a main travel spring (not shown) connected to the wiper sled 250 at spring post 252 and to the frame 201 (spring-frame connection not shown in FIG. 5). The main travel spring may operate in compression or tension, depending on the arrangement of its attachment to the frame 201. The wiper sled 250 includes rails 254 that cooperate with corresponding travel slots (not shown) in the frame 201, and which together constrain the wiper sled 250 to travel along the X-axis. The wiper sled 250 further includes pivot walls 256 with pivot faces 258. As will be described later, actuator arms 216 on the wiper mount 210 contact and ride along the pivot faces 258 (i.e., along the Z-axis) when the wiper 300 is moved from a non-wiping position to a wiping position. A forward edge 211 of the wiper mount 210 contacts undersides of stops 262. The stops 262 serve to push the wiper mount 210 down to the non-wiping position when the wiper sled retracts, should gravitational force not be sufficient. Further details of the construction and operation of the wiper mount 210 are provided below with respect to FIG. 6.

The wiper device 200 also includes spring-loaded trigger 400, which rotates through a limited angle about the X-axis at pivot point 402. Trigger spring 408 is attached at one end to the trigger mechanism 400 at spring tab 404 and its other end at a spring tab (not shown) on the frame 201. In an embodiment, trigger spring 408 is a tension spring. Alternately, a compression spring may be used to perform the same functions as the trigger spring 408. As can be seen, the attachment 404 of the trigger spring 408 is below the pivot point 402, and thus, the trigger spring 408, provides a potential that can act to rotate the trigger 400 in the clockwise direction. A stop 414 of the trigger 400 contacts tail 266 of the wiper sled 250, which, as can be seen in FIG. 5, includes straight portion 267 and bent portion 268 (partly obscured in FIG. 5). In the non-wiping position shown in FIG. 5, the stop 414 contacts the straight portion 267 and rotation of the trigger 400 thereby is prevented. However, when the wiper sled 250 is pulled in the −X-direction, the bent portion 268 of the tail 266 comes into contact with the stop 414 allowing clockwise rotation of the trigger 400. As the −X-direction travel of the wiper sled 250 reaches its limit, the stop 414 passes behind the trailing edge of the tail 266, cocking the trigger 400 and allowing the trigger 400 to rest against the frame 201. In this cocked position of the trigger 400, the +X-direction travel of wiper sled 250 is prevented. As will be described below, such clockwise rotation of the trigger 400 aligns paddle engagement face 406 of the trigger 400 with the rotational travel path of the paddle 505 on the output shaft 500 (see, e.g., FIG. 7) such that sufficient rotation of the output shaft 500 causes the paddle 505 to push the trigger 400 in the counter-clockwise direction, which causes the trigger 400 to release its lock on the wiper sled 250 and permit the wiper mount 210 to pivot the wiper 300 into the non-wiping position.

Figure 6:
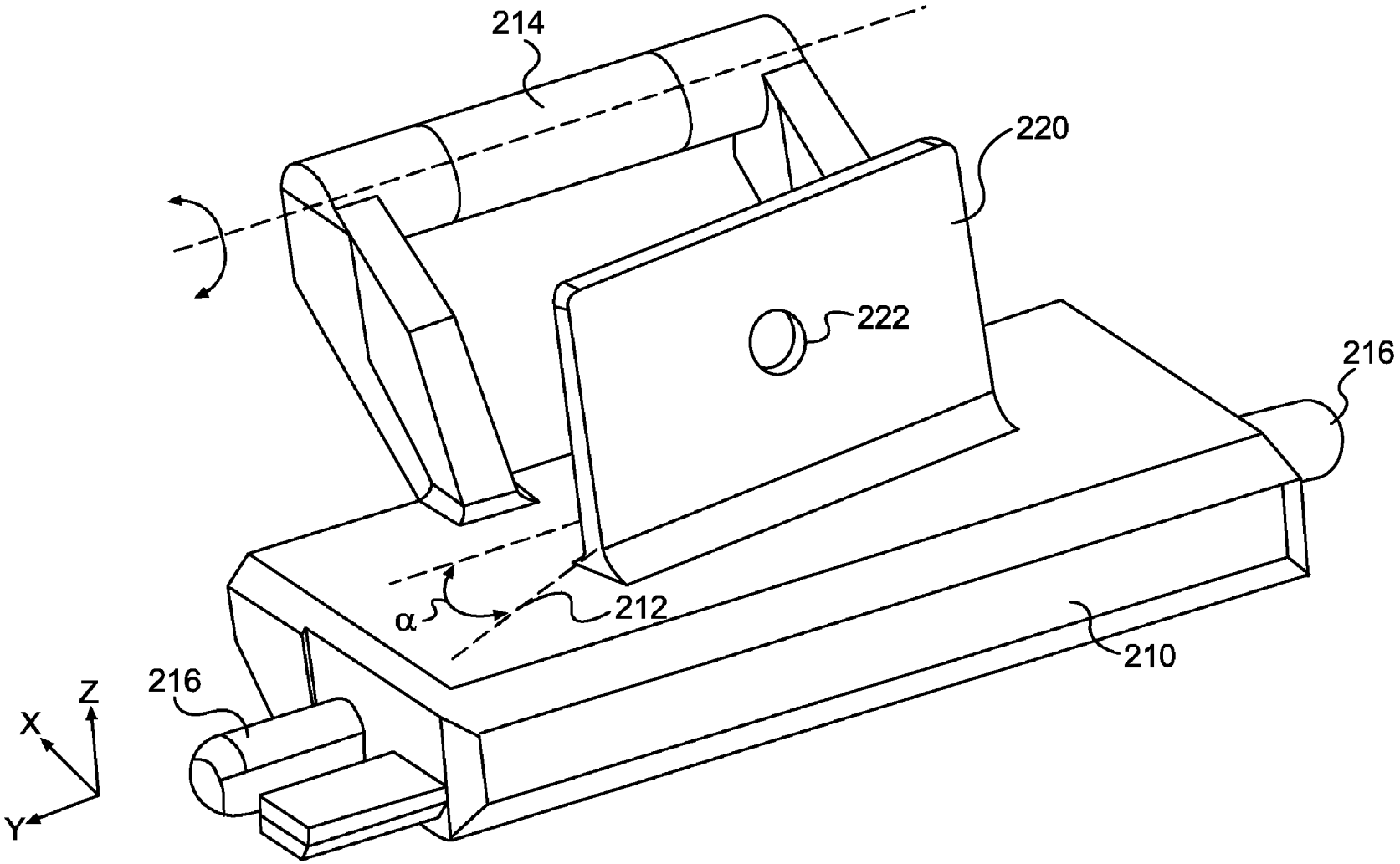
FIG. 6 is a perspective view of an embodiment of a wiper mount.

FIG. 6 is a perspective view of an example embodiment of a wiper mount for holding a single, compliant wiper. As shown in FIG. 6, pivotable wiper mount 210 includes pivot base 212, pivot arm 214, and actuator arms 216, which translate X-direction motion of the wiper sled 250 into Z-direction motion of the wiper mount 210. Also shown is wiper tab 220, which, in the illustrated embodiment, is installed at an angle $\alpha$ from the Y-axis, where $\alpha$ is a small angle. The angled wiper tab 220 is designed to securely hold the wiper 300 by way of an interference fit, and to correctly align the wiper 300 using assembly pin 222 for this purpose. As thus installed on the wiper tab 220, the wiper 300 wipes print head assemblies in a direction generally perpendicular to the carriage path of the inkjet printer 10 (i.e., as shown, at $90-\alpha$ degrees). In an alternate embodiment, the angle $\alpha$ may be reduced to zero degrees.

Figure 7:
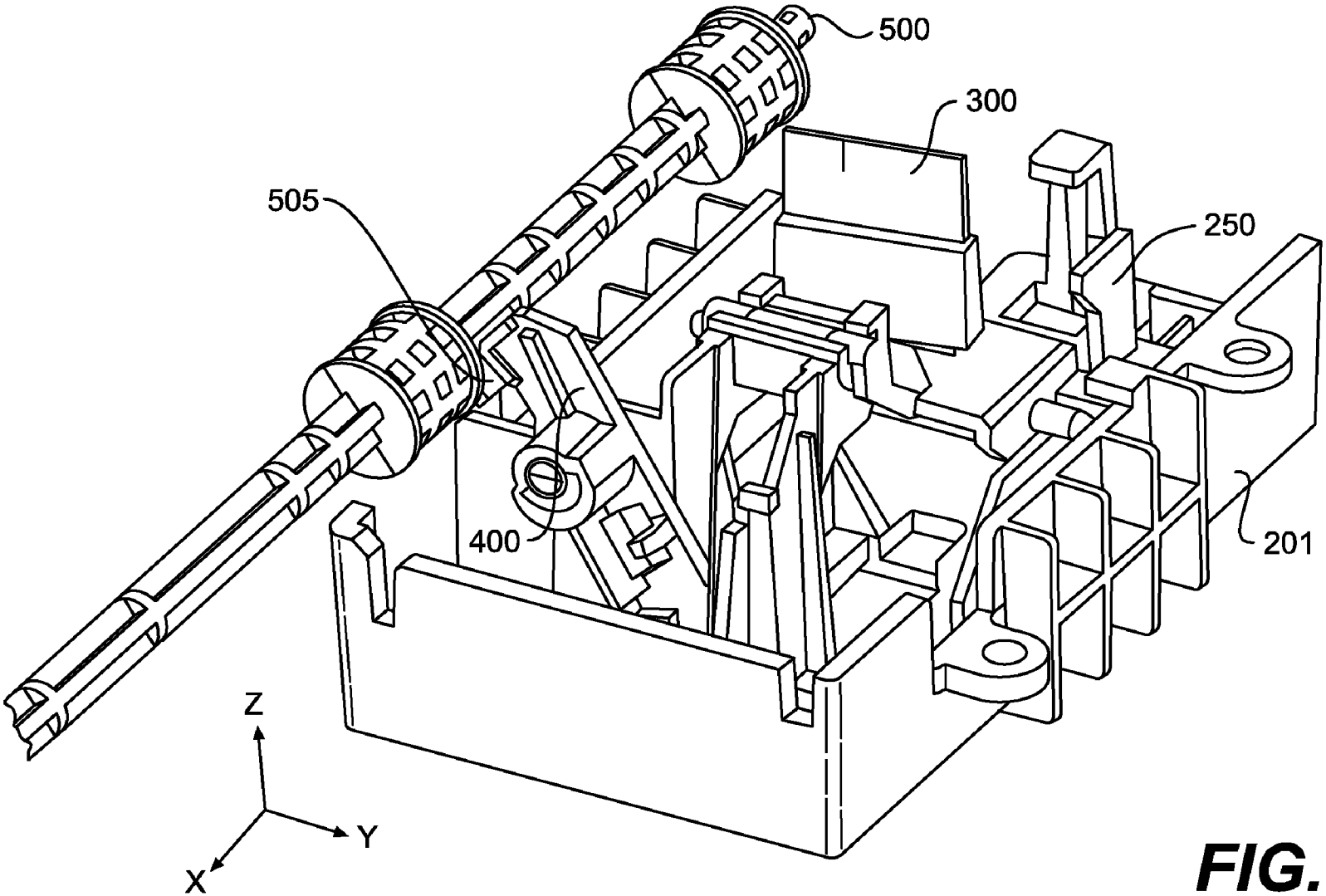
FIG. 7 is a perspective view of the embodiment of the wiping device of FIG. 5 installed in an embodiment of a frame with the wiper in a wiping position.

FIG. 7 is a perspective view of the embodiment of the wiper device of FIG. 5 installed in the frame 201 with the wiper 300 raised into the wiping position. Output shaft 500 is shown rotated such that paddle 505 just engages paddle engagement face of the trigger 400. Further clockwise rotation of the output shaft 500 will cause the paddle 505 to exert a force on the engagement face, which will pivot the trigger 400 such that the stop 414 no longer is locked behind the trailing edge of the tail 266 (see FIG. 5). When the trigger 400 becomes unlocked, the compressed main travel spring releases, exerting a force in the +X-direction and causing the wiper sled 250 to travel in the +X-direction. Such +X-direction travel of the wiper sled 250 allows the wiper mount 210 to pivot the wiper 300 into the non-wiping position.

Figure 8:
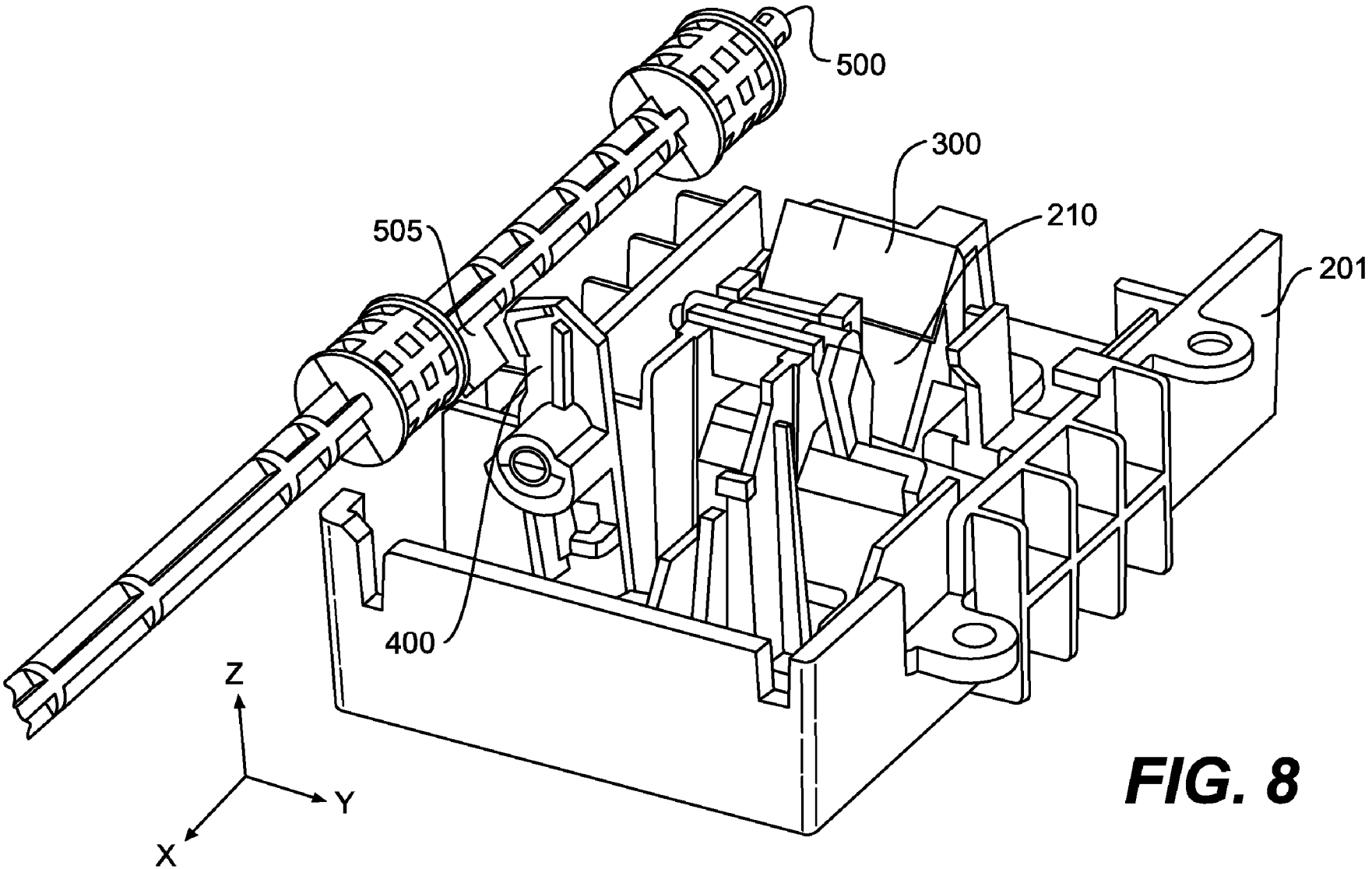
FIG. 8 is a perspective view of the embodiment of the wiping device of FIG. 5 installed in an embodiment of a frame with the wiper in a non-wiping position.

The result of such actuation of the trigger 400 is shown in FIG. 8. As can be seen, the trigger 400 has rotated in the counter-clockwise direction to an un-cocked position, and the wiper 300 and wiper mount 210 are pivoted into the non-wiping position and out of the inkjet printer printing path.

Figure 9:
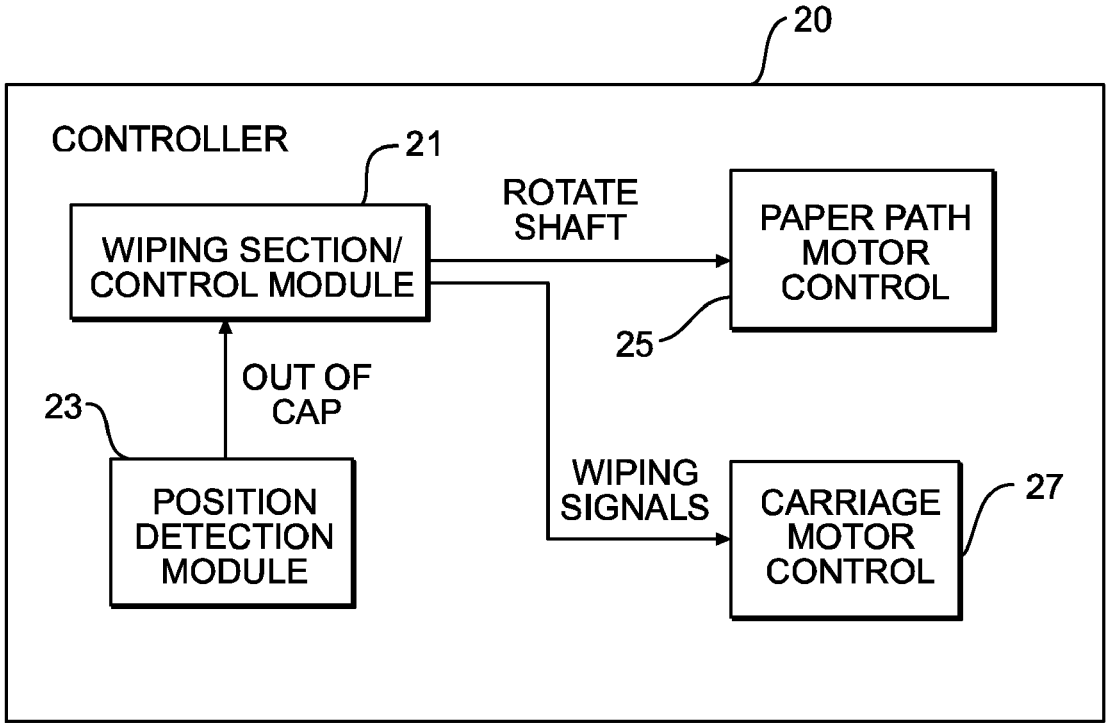
FIG. 9 is a block diagram of an embodiment of a printer controller that controls wiping operations of the wiping device of FIG. 5.

FIG. 9 is a block diagram of an embodiment of the controller 20 of FIG. 1 showing controller elements involved in an example wiping operation. The controller 20 includes wiping selection/control module 21, position detection module 23, paper path motor control module 25, and carriage motor control module 27. In the context of wiping operations, the carriage motor control module 27 sends signals to the carriage motor to move the carriage assembly 14 between an in cap position and a wiping position. The same carriage motor is used under the direction of the controller 20 to execute printing operations. The paper path motor control module 25 sends signals to energize or operate the paper path motor if desired, which in turn causes rotation of the paper motor output shaft 500 (see FIG. 3). The position detection module 23 detects when the print head assemblies 30/40 are out of cap, and sends a corresponding signal to the wiping selection/control module 21. The wiping selection/control module 21 includes programming to determine when a wiping operation is to be executed. A wiping operation implies non-actuation of the trigger 400; for non-wiping operations, such as printing, the trigger 400 is actuated. In an embodiment, such programming may be implemented in hardware or firmware, and is set upon manufacture of the inkjet printer 10. As examples, the programming may be set to execute a wiping operation every eighth time the print head assemblies 30/40 go in cap, or following any image (photograph) printing operation. Thus, the programming includes logic to count times into cap, or otherwise determine when a desired wiping threshold or condition has been reached. For example, the wiping selection/control module 21 may receive a signal from a printer driver (not shown) when an image (photograph) is being printed, which signal the module 21 uses to determine that a wiping operation is to be conducted when the print head assemblies 30/40 are placed in cap. The wiping operation may be executed when going in cap, when coming out of cap, if the controller 20 senses that the print head assembles 30/40 were left uncapped on power up of the printer, upon going into cap after a printing operation when the print head assembles 30/40 had been in cap for greater than a specified time such as two weeks, between pages of a printing operation, or when a customer invokes a recovery routine through the printer driver, for example. Thus, to execute a wiping operation, the print head assemblies 30/40 are first placed in cap, which, through −X-direction travel of the cap sled 100, raises the wiper 300 to the wiping position and locks the wiper 300 in this position. The print head assemblies 30/40 then are taken out of cap, and without rotation of the output shaft 500, the carriage 14 moves the print head assemblies 30/40 past the wiper 300. The print head assemblies then may be placed back in cap, with the wiper 300 remaining in the wiping position. Movement of the carriage 14, by the carriage motor, for such wiping operations, is controlled by wiping signals sent from the wiping selection/control module 21 to the carriage motor control module 27. Upon the next uncapping operation, the wiping selection/control module 21 determines that a wiping operation is not to be executed and sends a rotate shaft signal to the paper path motor control module 25. The paper path motor control module 25 sends a signal to energize the paper motor for a time sufficient for the paddle 505 to push against the trigger 400, which actuates the trigger 400, and the wiper 300 is lowered to the disengaged position so that printing operations may be conducted.

Figure 10:
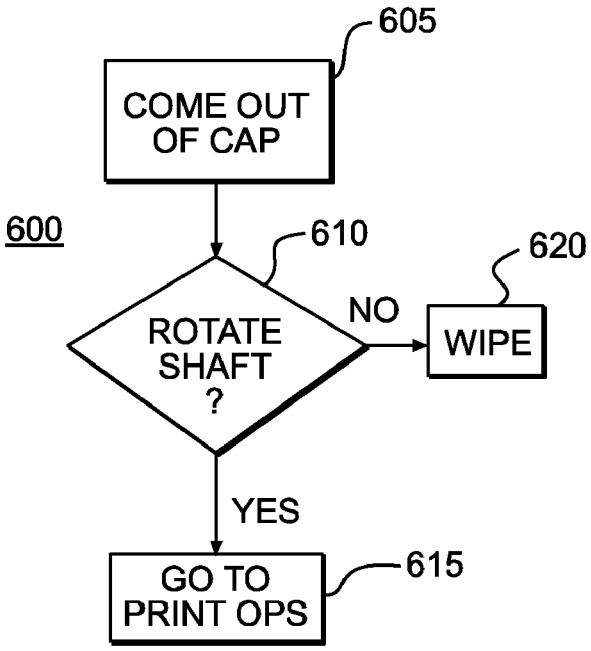
FIG. 10 is a flow chart illustrating an embodiment of an operation of the wiping device of FIG. 5.

FIG. 10 is a flowchart illustrating an embodiment of an operation of the wiping device 200 of FIG. 5. In FIG. 10, operation 600 begins in block 605 when print head assemblies 30/40 are taken out of cap and the wiping selection/control module 21 receives an out of cap signal from the position detection module 23. In block 610, the wiping selection control module 21 determines if a wiping operation is to be executed and the output shaft 500 rotated. If a wiping operation is not to be executed, the output shaft 500 is rotated (Y—yes) and the operation proceeds to block 615, the trigger 400 is actuated (released), the wiper 300 is dis-engaged, and printing operations are enabled. If a wiping operation is to be executed, the output shaft 500 is not rotated (N—no) and the trigger 400 is not actuated. The operation 600 then proceeds to block 620. In block 620, the wiping operation is executed (which may include multiple passes past the wiper 300). Following the wiping operation of block 620, the inkjet printer may proceed with printing, or other operations.

FIGS. 11A-11F illustrate mechanical components of an alternative embodiment of a wiping device. The mechanical components 700 may be installed in the inkjet printer 10 shown in FIG. 1, and may use and connect to components that are the same as or similar to those shown in FIG. 3, including frame 201 and cap sled 100, for example. In this embodiment, the carriage motor is used to raise the wiper 300 to the wiping position and to lower the wiper 300 to the non-wiping position. Operation of the carriage motor in this embodiment also takes the print head assembles 30/40 out of cap when the wiper 300 is raised and places the print head assemblies 30/40 back into cap to lower the wiper 300. As will be described with reference to FIGS. 11A-11F, initially the wiper 300 is in a non-wiping position (see, e.g., FIG. 11A) when the print head assemblies 30/40 are in cap. Taking the print head assemblies 30/40 out of cap in this initial condition does not raise the wiper 300 to the wiping position. However, subsequently placing the print head assemblies 30/40 in cap will raise the wiper 300 to the wiping position, and the wiper 300 is held in the wiping position by the position of the cap sled 100. The next uncapping of the print head assemblies 30/40 engages a trigger that serves to hold the wiper 300 in the wiping position until the trigger is actuated. If a wiping operation is desired (i.e., programmed), wiping is conducted this first time the print head assemblies 30/40 come out of cap with the trigger set, and after the wiping operation, the print head assemblies 30/40 are then placed back in cap to actuate the trigger and consequently lower the wiper 300 to the non-wiping position. If a wiping operation is not programmed, the print head assembles 30/40 are place back into cap, which lowers the wiper 300 to the non-wiping position. Thus, when coming out of cap for a printing operation, the wiper 300 always is in the non-wiping position, which speeds up the printing process.

Figure 11A:
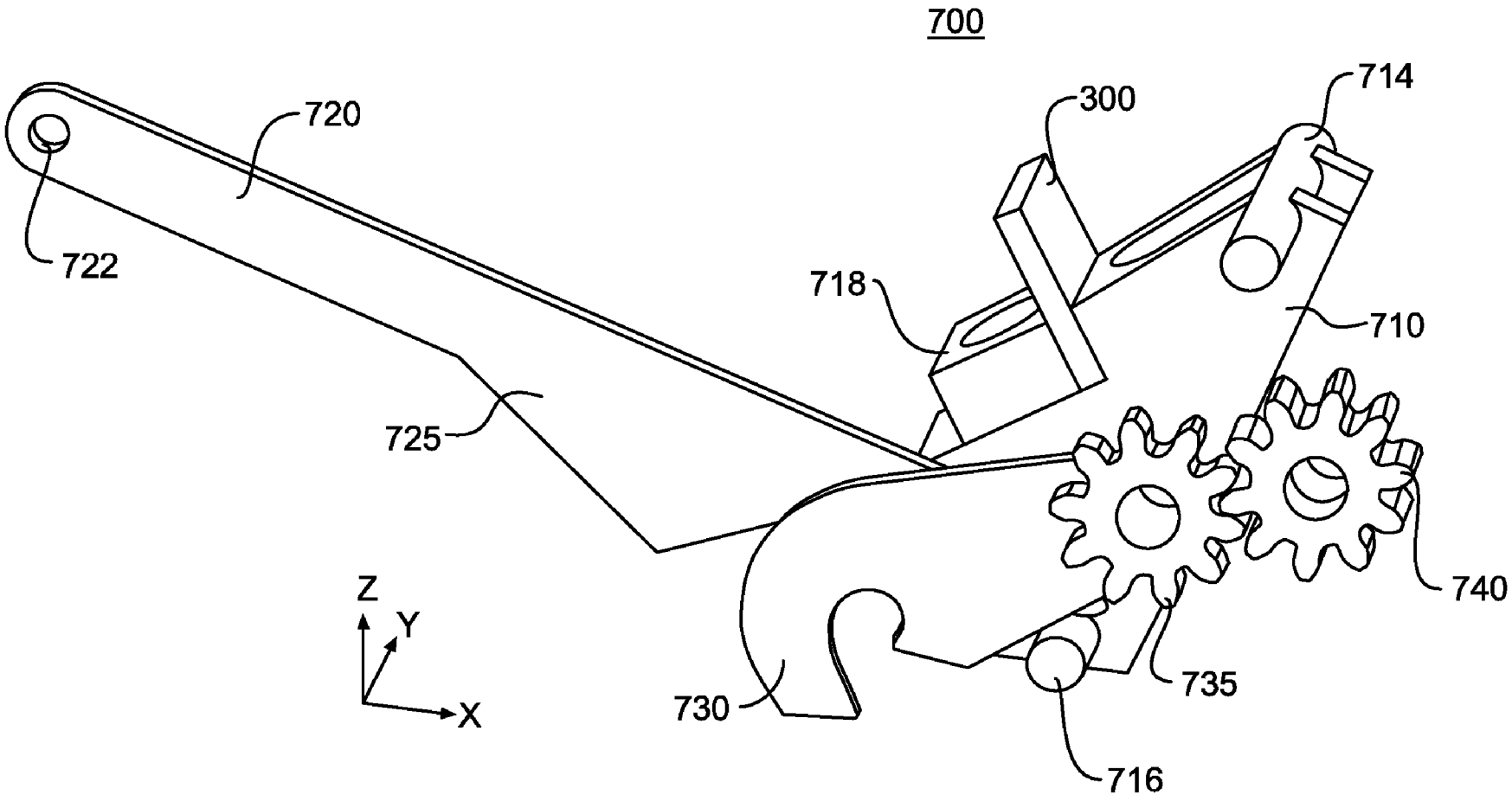
FIGS. 11A-11F illustrate mechanical components of another embodiment of a wiping device.
Figure 11B:
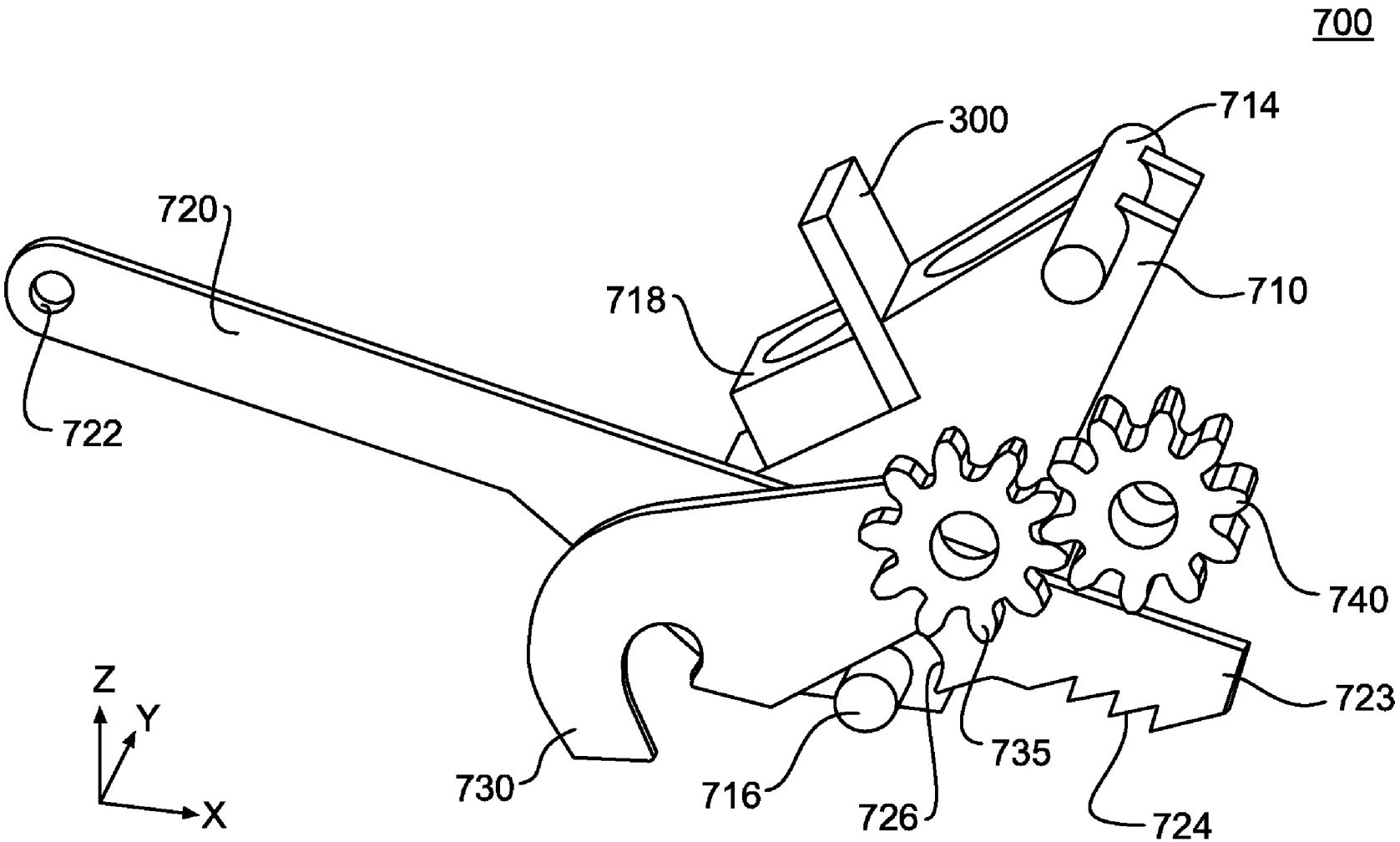

FIG. 11A illustrates pivotable wiper mount 710 having pivot pin 714 and actuator arm 716, and mount 718 for holding compliant wiper 300. The pivotable wiper mount 710 may be located in a structure corresponding to that provided in the frame 201 of FIG. 3 for the wiper mount 210. Also shown in FIG. 11A are lever arm 720, latch 730, which terminates in latch cog 735, and trip cog 740. Teeth located on the cogs 735 and 740 are engaged such that rotation of the cog 740 causes corresponding rotation of the cog 735 and movement of the latch 730. The cog 740 is thicker than the cog 735 so that the cog 740 can be engaged by the lever arm 720, as will be described below, as well as by the cog 735. Lever arm 720 includes pivot point 722, which connects to cap sled 100 (see FIG. 3) such that +/−X-direction travel of the cap sled 100 causes the lever arm 720 also to move, generally, in the +/−X directions. Lever arm 720 also includes triangular protrusion 725. Because the lever arm 720 has triangular protrusion 725, the X-direction travel causes some rotation of the lever arm 720 about the pivot point 722. Additional features of the lever arm 720 are shown in FIG. 11B. In FIG. 11A, the print head assemblies 30/40 (see FIG. 2) are capped, wiper 300 is in the non-wiping position, and the inkjet printer 10 is ready to print.

FIG. 11B illustrates generally +X-direction movement of the lever arm 720 as the print head assembles 30/40 come out of cap. Because the lever arm 720 is pivotably fixed to the cap sled 100 at pivot point 722, +X direction movement of the cap sled 100, which occurs during uncapping, causes +X-direction travel of the lever arm 720. As can be seen in FIG. 11B, a forward end 723 of the lever arm 720 includes a number of teeth 724, and a notch section 726 located behind the teeth 724. The notch section 726 is seen to be engaged with actuator arm 716. The wiper 300 is in the non-wiping position and the inkjet printer 10 is ready to print.

Figure 11C:
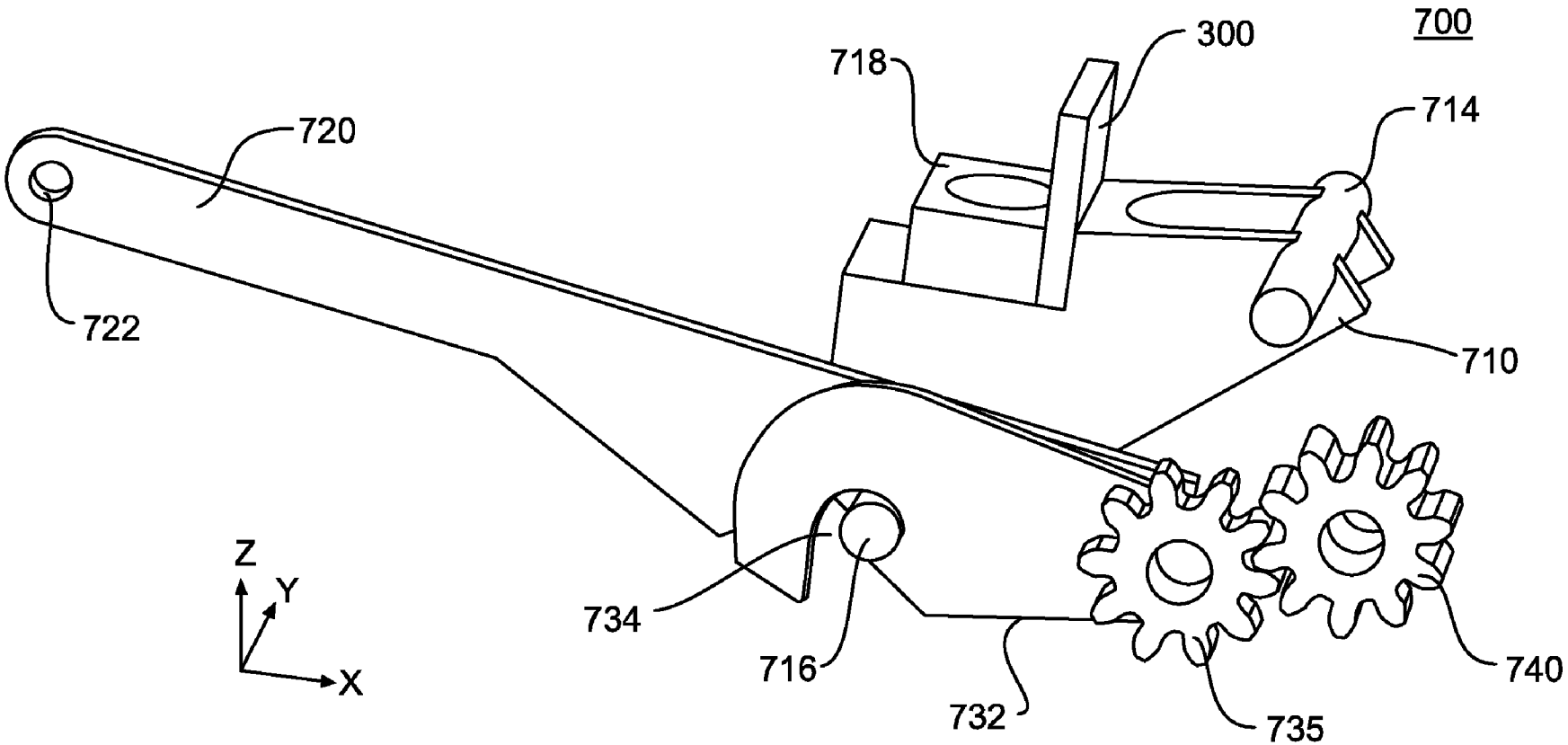

FIG. 11C illustrates the wiper device components 700 after the print head assemblies 30/40 are capped. In FIG. 11C, the lever arm 720 has been pulled in the −X-direction by the capping operation of the cap sled 100. Because the notch section 726 (see FIG. 11B) is engaged with the actuator arm 716, the −X-direction travel of the pivot arm 720 causes the pivotable mount 710 to rotate in the clockwise direction until the wiper 300 reaches the wiping position shown in FIG. 11C. As the wiper mount 710 pivots the wiper 300 to the wiping position, the actuator arm 716 rides against bottom edge 732 of latch 730 until the actuator arm 716 is engaged with latch notch 734, as shown. In FIG. 11C, the wiper 300 is in the wiping position, and the print head assembles 30/40 are capped.

Figure 11D:
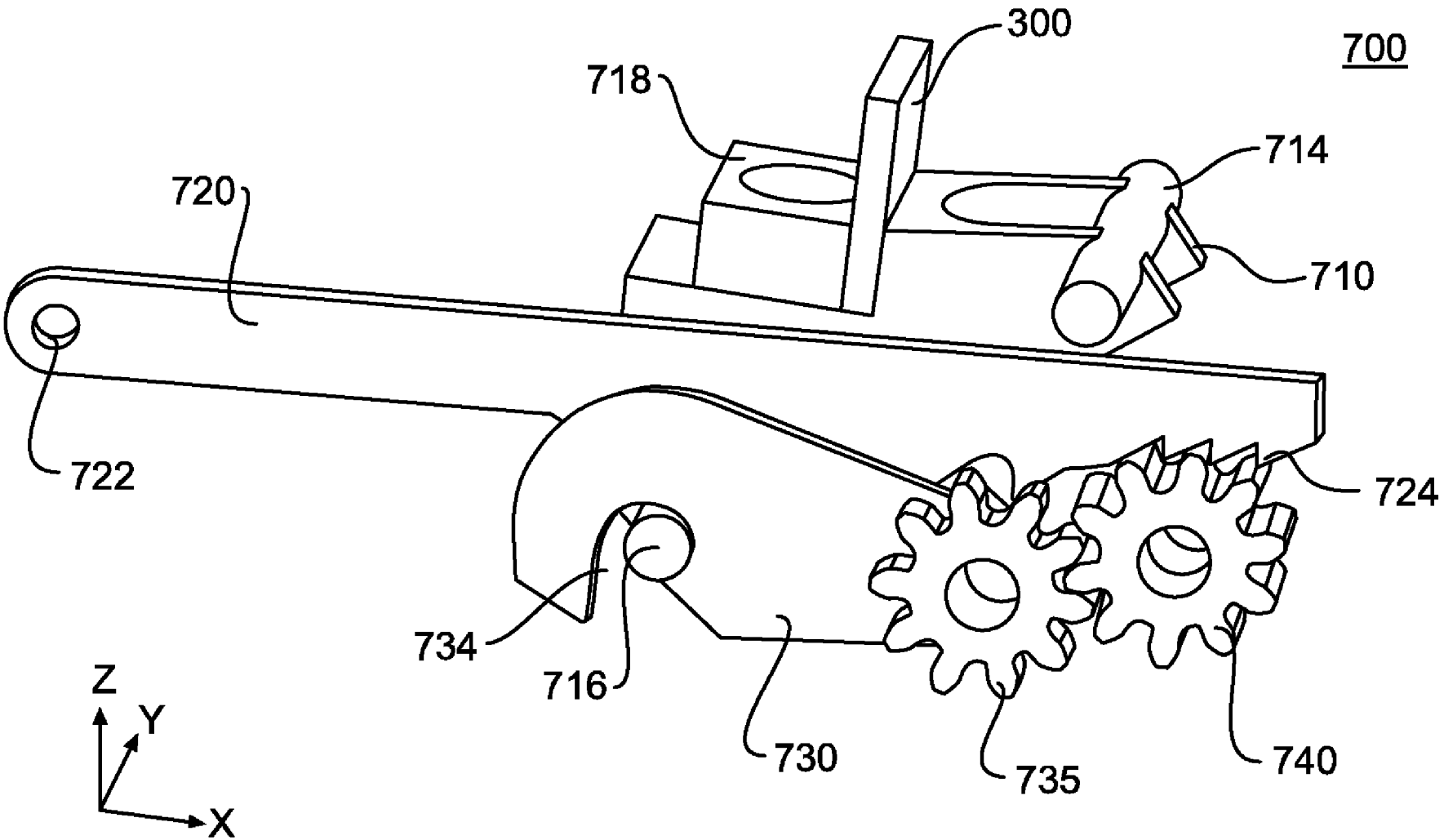

FIG. 11D shows the result of uncapping the print head assembles 30/40. The +X-direction travel of the capping sled 100 to uncap the print head assembles 30/40 causes the lever arm 720 to move generally in the +X-direction. At the end of such movement of the lever arm 720, the lever arm teeth 724 engage teeth of the trip cog 740. The wiper mount 710 and wiper 300 are held in the wiping position by engagement of the actuator arm 716 by the latch notch 734. The lever arm 720 now is in a tripping position, and the print head assembles 30/40 may be wiped.

Figure 11E:
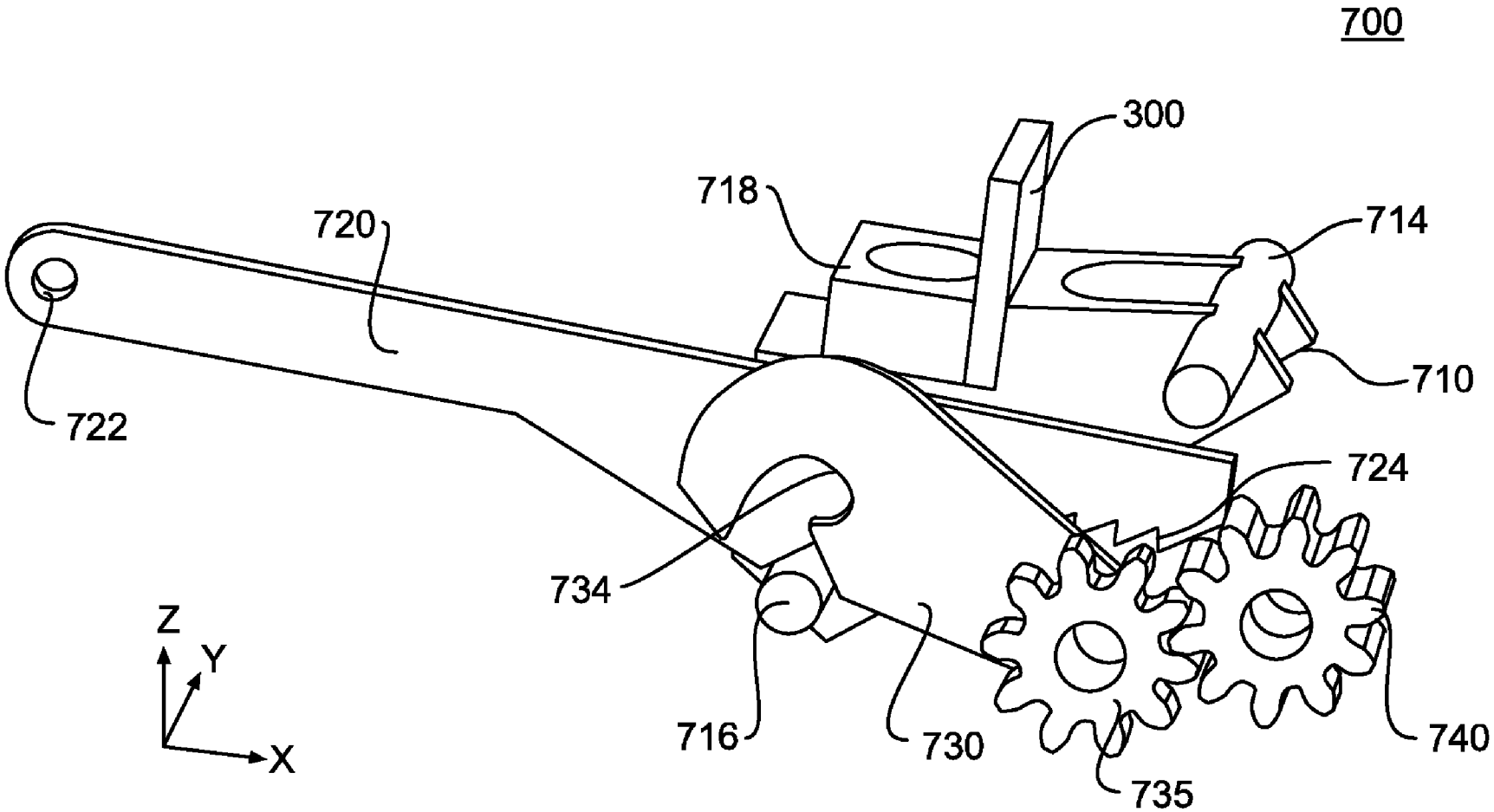
Figure 11F:
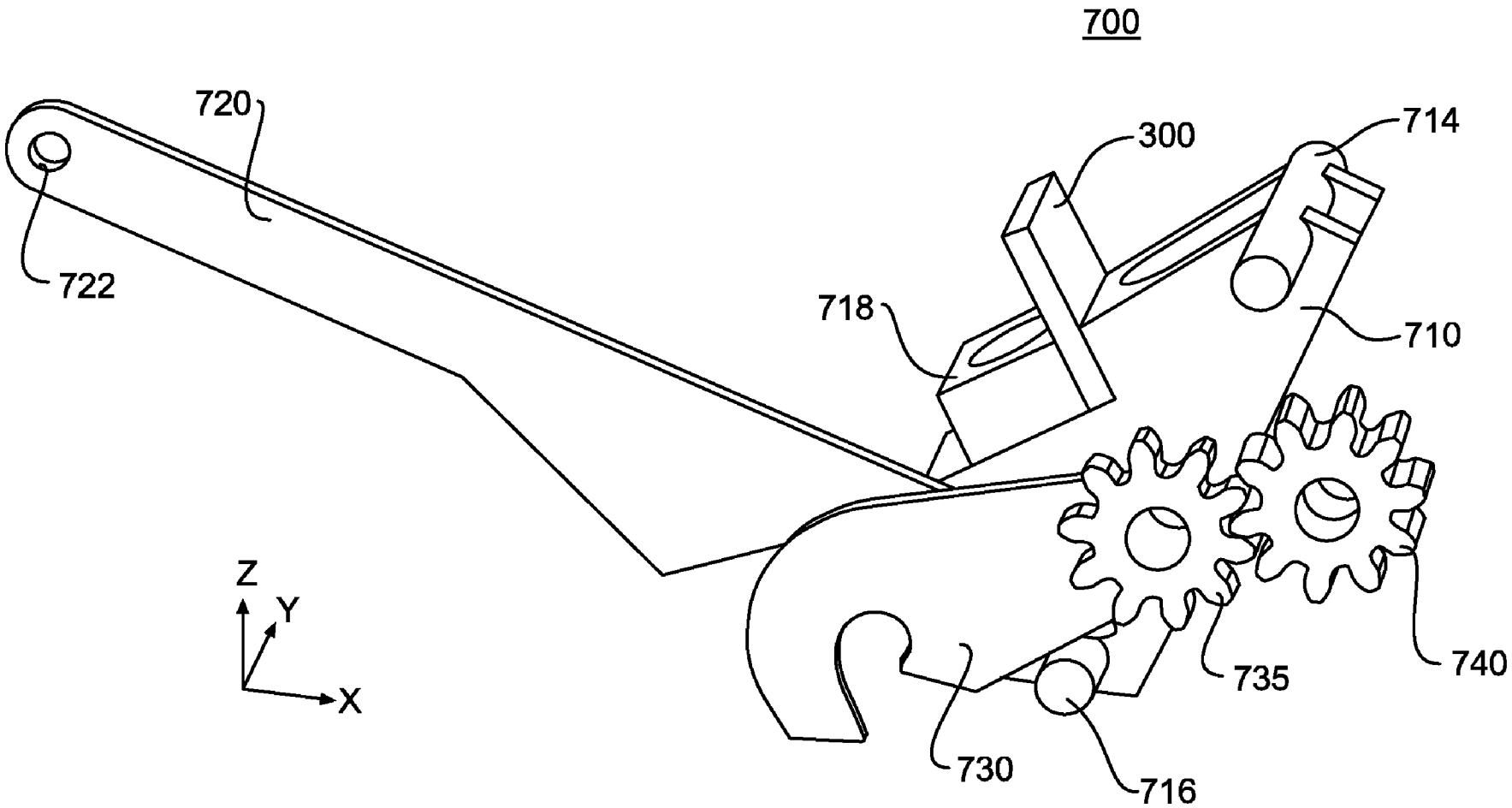

FIG. 11E shows the result of capping the print head assembles 30/40 once the lever arm 720 is in the tripping position. The −X-direction travel of the lever arm 720 that accompanies the capping operation causes the teeth 724 of the lever arm 720 to impart a rotational movement to the trip cog 740. Rotation of the trip cog 740 causes the latch cog 735 to rotate and the latch 730 to rise up off the actuator arm 716 in a clockwise direction. With the latch notch 734 no longer engaged with the actuator arm 716, the wiper mount 710 is free to pivot back to the non-wiping position, generally under the force of gravity, or with the assistance of a structure similar to the stops 262 of FIG. 5, or alternatively, through use of a spring. When so released by tripping of the latch 730, the wiper device mechanical components 700 assume the positions illustrated in FIG. 11F.

Figure 12:
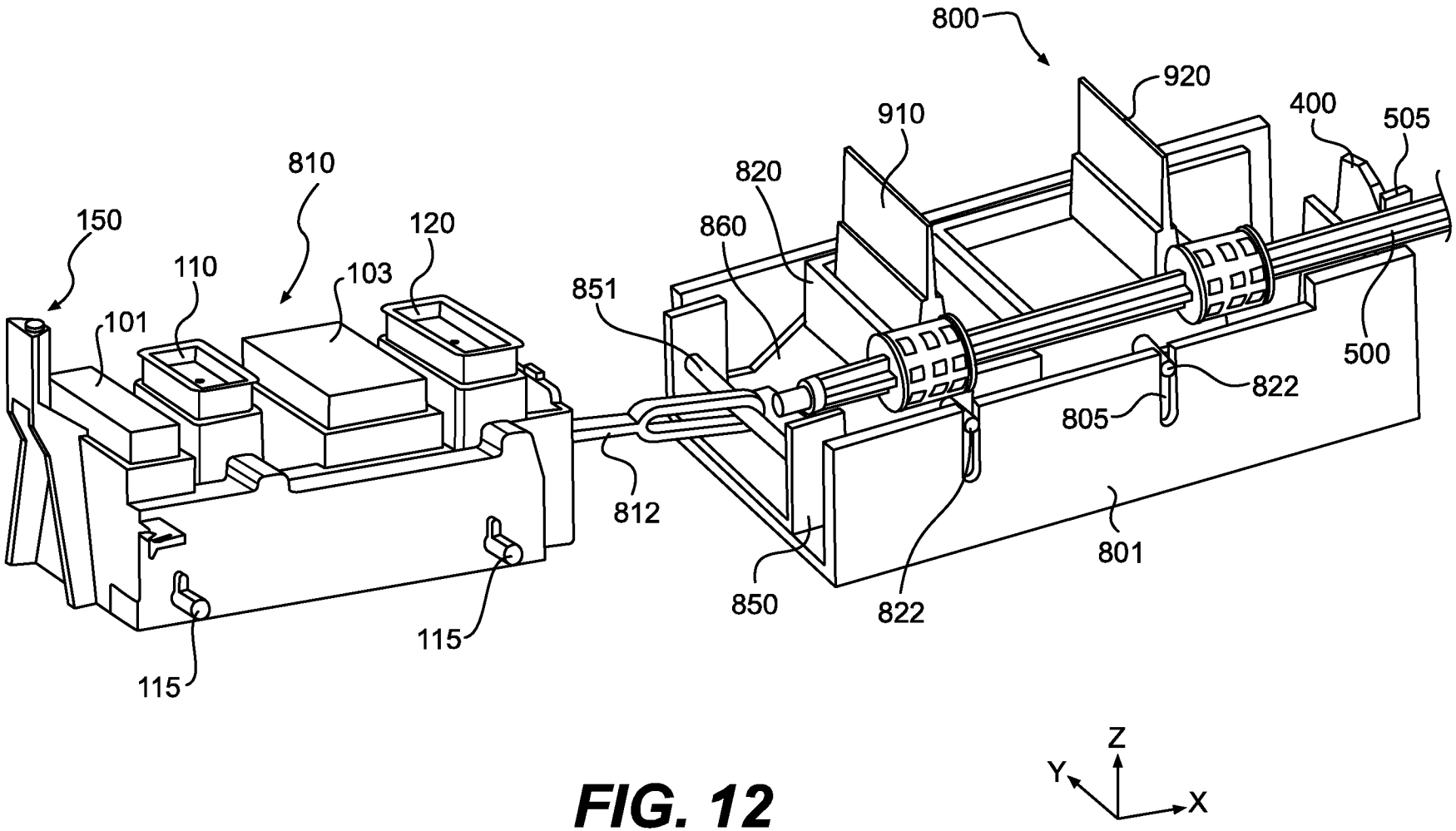
FIG. 12 illustrates an alternate embodiment of mechanical components of an inkjet printer wiping device.

FIG. 12 illustrates an alternative embodiment of an inkjet printer wiper device. In FIG. 12, cap sled 810 includes compliant caps 110 and 120. The caps 110 and 120 are used, respectively, to cap the color- and black-ink print head assemblies 40 and 30 when, for example, there are no printing operations in progress, so as to limit dry-out of ink at the orifice plate areas 32, 42 (see FIG. 2). Adjacent to the caps 110 and 120 are, respectively, blotters 101 and 103. To provide the desired +X/−X movement of the cap sled 100, carriage 14 (see FIG. 1) that houses the print head assemblies contacts the cap sled 100 by way of cap sled pin 150. As the carriage 14 pushes against the pin 150, the cap sled 100, in an embodiment, is driven up a short, shallow ramp to create +Z-direction travel of the caps 110/120. Once driven completely up the ramp, the cap sled 100 is in its capping position and the caps 110 and 120 press against their respective print head assemblies, create an adequate seal, and thus create a desired humid environment around the print head assembly orifice plate areas.

Frame 801 is fixed within the inkjet printer 10 (FIG. 1). Frame 801 is used to locate mechanical components of wiping device 800, including slider 850 and trigger 400. Cap sled 100 is coupled to slider 850 by interaction between coupler 812 on the cap sled 100 and slider bar 851. Trigger 400 may be engaged by paddle 505 of output shaft 500, which in turn is operated by a paper path motor (not shown).

In the embodiment shown in FIG. 12, the wiper device 800 includes two compliant wipers, 910 and 920. Alternatively, a single wiper could be used. The wipers 910 and 920 are mounted in wiper mount 820.

Slider 850 includes ramp 860 over which the wiper mount 820 travels to raise and lower wipers 910 and 920. That is, −X direction travel of the cap sled 800 pulls the slider 850 in the −X direction, causing the ramp 860 to engage the wiper mount 820 and raise the wiper mount 820 in the +Z direction into the wiping position. To control movement of the wiper mount 820, wiper mount pins 822 (two of four shown) ride in the +−Z-direction in frame slots 805. The −X-direction travel of the slider 850 causes a slider return spring (not shown) to store potential energy. With the slider return spring in this energy storage state, the slider 850 is held in the −X-direction position and the wipers 910 and 920 are held in the wiping position by operation of the trigger 400, as explained above with respect to FIGS. 3-8. The trigger 400 is actuated by rotation of the output shaft 500, and the spring force from the slider return spring moves the slider 850 in the +X-direction. This +X-direction travel of the slider 850 causes the wiper mount 820 to slide down the ramp 860, moving the wipers 910 and 920 to the non-wiping position and allowing printing operations to be performed.

In yet another alternative embodiment, rather than using ramp 860 to translate X-direction travel of the slider 880 into Z-direction travel of a wiper, a planar linkage mechanism may be used. A specific example of a planar linkage mechanism is a four-bar linkage mechanism. Such a four-bar linkage mechanism can translate X-direction motion of the slider 850 into Z-direction motion of the wipers 910/920. Other mechanisms may be used to translate X-direction motion into Z-direction motion.

The above-described wiping devices are thus selectable such that a wiping operation is executed when appropriate for the design and intended use conditions of the inkjet printer. Furthermore, the wiping operation is executed before placing the print heads "in cap", so as not to slow printing operations. A wiping device is mounted in the path of the print head assemblies, but it can retract out of the way of the print head assemblies during printing operations. In this manner, a wiping device is raised when the print head assemblies need to be cleaned, but is lowered and stored out of the way of the print head assemblies during printing operations. Operation of the wiping devices leverages existing inkjet printer systems, such as the carriage system and the paper path system, so that wiping operations do not require a complicated transmission and a separate power source, which allows for a very low cost implementation.

We claim:

1. A wiping device for an inkjet printer, comprising:

a wiper mount movable between a wiping position and a non-wiping position;

a slider coupled to the wiper mount, the slider translatable between a retracted position and a deployed position, and wherein a first translation of the slider to the deployed position causes the wiper mount to move into the wiping position;

a trigger, operable between a cocked position and an un-cocked position, that, in the cocked position, locks the wiper mount in the wiping position, wherein when the trigger is actuated, the trigger moves to the un-cocked position and the wiper mount moves to the non-wiping position; and logic to control actuation and non-actuation of the trigger, wherein the logic determines to actuate or not actuate the trigger in response to a print head assembly of the inkjet printer being removed from a cap.

2. The wiping device of claim 1, wherein the logic is implemented on a suitable processor and comprises routines to actuate the trigger without execution of a wiping operation, and wherein the logic determines the existence of a condition for non-actuation of the trigger.

3. The wiping device of claim 1, wherein the slider device comprises a connection to a cap sled of the inkjet printer, the cap sled coupled to a carriage motor that operates to cause the first translation of the slider device.

4. The wiping device of claim 3, wherein the trigger is actuated by operation of the carriage motor.

5. The wiping device of claim 3, wherein the trigger is actuated by an operation of a paper path motor of the inkjet printer.

6. The wiping device of claim 5, wherein the slider comprises a wiper sled, and wherein the paper path motor is coupled to an output shaft having a paddle, wherein upon rotation of the output shaft by the paper path motor, the paddle contacts the trigger to actuate the trigger.

7. The wiping device of claim 6, wherein the wiper sled comprises a return spring that stores potential energy during the first translation, and wherein the potential energy of the return spring is released upon the actuation of the trigger, wherein the wiper sled completes a second translation to return to the retracted position, and wherein the trigger comprises a trigger spring that moves the trigger to the cocked position.

8. The wiping device of claim 3, wherein:

the slider comprises:

a lever arm having formed on one end a pivot point and on an opposite end, trip cog engagement teeth, and having a notch for engagement with the wiper mount to cause the wiper mount to move into the wiping position; and wherein the trigger, comprises:

a trip cog having teeth to engage the lever arm trip cog engagement teeth, and a latch having formed at one end, a latch cog that engages the trip cog, and at opposite end, a latch notch that engages with the wiper mount to lock the wiper mount in the wiping position during wiping operations of the inkjet printer, and wherein a second translation of the slider causes the latch notch and the wiper mount to disengage, wherein the wiper mount moves to the non-wiping position.

9. The wiping device of claim 1, wherein the logic determines a condition for non-actuation of the trigger based on a number of times the print head assembly of the inkjet printer has been placed in the cap, and wherein when the trigger is not actuated, a wiping operation is executed under control of the logic.

10. The wiping device of claim 9, wherein the logic controls execution of the wiping operation when placing the print head assembly in cap.

11. The wiping device of claim 10, wherein the wiping operation comprises:

taking the print head assembly out of cap; and moving the print head assembly past the wiper mount.

12. The wiping device of claim 1, wherein the logic is implemented in a mechanical device.

13. A wiping device for use with an inkjet printer having installed therein one or more print head assemblies movable under control of a carriage motor, and a paper path system movable under control of a paper path motor, the device comprising:

a trigger that is cocked to lock a wiper in a wiping position;

a release mechanism to actuate the trigger to allow the wiper to move to a non-wiping position; and logic to control operation of the release mechanism so as to not actuate the trigger, wherein the logic determines to actuate or not actuate the trigger in response to one or more of the print head assemblies of the inkjet printer being removed from a capped position.

14. The device of claim 13, wherein the release mechanism is operated by rotation of the paper path motor.

15. The device of claim 14, wherein the release mechanism comprises a paper path motor output shaft having a paddle that cooperates with the trigger.

16. The device of claim 15, wherein the logic is implemented on a suitable processor and wherein operation of the release mechanism is controlled by the logic so as to wipe the print head assemblies upon an occurrence of a specific event comprising a number of times the print head assembles are placed in cap.

17. The device of claim 13, wherein the logic further comprises:

programming to control operation of the carriage motor during a wiping operation; and programming to cause actuation of the trigger without execution of a wiping operation.

18. A method for scan-axis wiping print head assemblies of an inkjet printer, the inkjet printer including a carriage motor that moves the print head assemblies in a scanning direction past a wiper, and a paper path motor that moves a print medium in a direction perpendicular to the scanning direction, the method implemented by logic in a suitably-programmed processor of the inkjet printer, and comprising:

determining whether or not a condition exists for wiping the print head assemblies;

if a condition exists for wiping the print head assemblies, providing a signal to the carriage motor to move the print head assemblies from a capped position past the wiper, wherein the wiper is fixed in a wiping position by a cocked trigger, the wiper movable between the wiping position and a non-wiping position; and providing a signal to actuate the cocked trigger, wherein actuation of the cocked trigger causes the wiper to move to the non-wiping position, wherein a determination to actuate or not actuate the cocked trigger is made in response to the print head assemblies being removed from their respective caps.

19. The method of claim 18, wherein non-actuation of the cocked trigger is controlled by the logic so as to wipe the print head assemblies upon an occurrence of a specific event.

20. The method of claim 19, wherein the specific event is selectable to maintain pen health and maximize speed of a first page out.

* * * * *